United States Patent [19]

Levi

[11] Patent Number: 4,512,331

[45] Date of Patent: Apr. 23, 1985

[54] OVEN SEAL ARRANGEMENT

[75] Inventor: David E. Levi, Chattanooga, Tenn.

[73] Assignee: The Maytag Company, Newton, Iowa

[21] Appl. No.: 613,577

[22] Filed: May 24, 1984

[51] Int. Cl.[3] ..... F24C 15/02

[52] U.S. Cl. ..... 126/190; 49/489; 126/273 R

[58] Field of Search ..... 126/19 R, 21, 190, 273 R; 49/500, 489, 485; 277/228, 229, DIG. 6

[56] References Cited

U.S. PATENT DOCUMENTS

| | | | |
|---|---|---|---|
| 2,327,541 | 8/1943 | Matheny | 126/190 |
| 2,836,268 | 5/1958 | Evans | 126/190 |
| 3,439,668 | 4/1969 | Tilus | 126/190 |
| 3,596,651 | 8/1971 | Welshofer et al. | 126/190 |
| 4,214,571 | 7/1980 | Scherer | 126/190 |
| 4,229,921 | 10/1980 | Schell | 126/190 |

FOREIGN PATENT DOCUMENTS

| | | | |
|---|---|---|---|
| 2414072 | 10/1974 | Fed. Rep. of Germany | 126/190 |

*Primary Examiner*—James C. Yeung
*Attorney, Agent, or Firm*—R. L. Ward

[57] ABSTRACT

An improved oven seal arrangement is provided comprising an elongated flexible seal having retainer and seal portions. A channel or gap is formed in one of the oven front or oven door for receiving the retainer portion and the seal portion is captured between the oven door and the oven front.

13 Claims, 7 Drawing Figures

OVEN SEAL ARRANGEMENT

BACKGROUND OF THE INVENTION

This invention relates generally to the field of oven seal arrangements and more particularly to an oven seal arrangement which is readily removable and serviceable.

Prior art oven seal arrangements have included seals mounted to the oven door as well as seals which are mounted directly to the main front of the oven. U.S. Pat. No. 3,596,651 issued to Welshofer et al on Aug. 3, 1971, teaches a self-cleaning gas-fired oven which includes a door mounted oven seal. The seal includes a sealing bead portion and a flange portion and is attached to the oven door by clamping the flange of the seal between the inner and outer door layers. This clamping action extends around the periphery of the oven door.

U.S. Pat. No. 4,214,571 issued to Scherer on July 29, 1980, discloses an oven having a seal attached to the oven front. In this arrangement, an oven liner is mounted within the opening of an oven body and a space is formed between the oven liner and the oven body. A gasket or seal is first mounted around the periphery of a cover panel and the cover panel is then attached to the oven body to clamp the seal or gasket between flanges 60 and 70 of the cover panel and oven liner respectively.

The prior art has thus shown seal arrangements which have been mounted on the door of an oven and seal arrangements which have been mounted on the front of an oven. Both of these seal mounting arrangements provide for clamping the seal to either the door or around the oven opening and require disassembly of structural panels to service the seal. There has been no known showing, however, of a flexible seal arrangement which is mounted on either the door or the front of the oven by sliding a retainer portion of the seal arrangement into a channel and then around the periphery of the door or oven. The retainer portion of this flexible seal arrangement is thus captured within a channel and a seal portion is disposed between the door and the front of the oven.

SUMMARY OF THE INVENTION

It is therefore an object of the instant invention to provide an improved oven seal arrangement.

It is a further object of the instant invention to provide an oven seal arrangement which is readily accessible for installation and for servicing.

Briefly, the instant invention achieves these objects in an oven including a stationary portion defining an oven cavity open at one end and a wall portion adjacent the open end of the oven cavity. The oven further includes a movable portion in the form of an oven door operable between an open position and a closed position juxtaposed to the wall portion of the oven for effectively covering the open end of the oven cavity. A channel is located in one of the stationary and movable portions. The channel includes a narrowed opening and extends substantially around the perimeter of the open end of the oven cavity with the oven door in the closed position. An elongated seal includes a retainer portion slidably received in the channel. The seal further includes a seal portion which is cooperable with the stationary and movable portions to provide a seal arrangement therebetween.

Operation, installation and construction of the oven seal arrangement and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
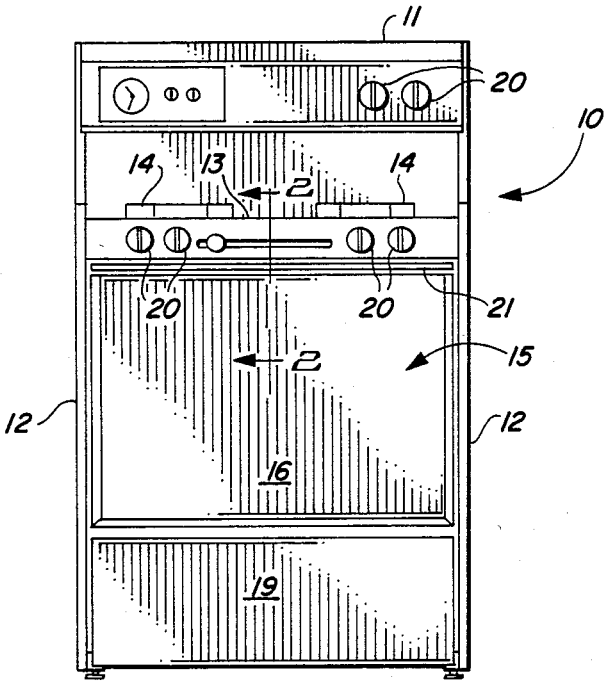
FIG. 1 is a front elevation view of a free-standing range utilizing the oven seal arrangement of the instant application.

Referring in particular to FIG. 1, there is shown a free-standing range 10 of the type generally known in the appliance industry. The range 10 illustrated in FIG. 1 includes a substantially rectangular cabinet 11 having generally vertical side walls 12 and a generally horizontally disposed top surface 13 for mounting a plurality of surface burners 14. The generally vertical frontal plane of the range designated 15 includes a hinged oven door 16 and a lower access panel 19. A plurality of control knobs 20 are provided to facilitate operation of the surface burners 14 and the oven. Although the description of the oven seal arrangement of the instant invention is embodied in the free-standing range 10 of FIG. 1, it is to be understood that this oven seal arrangement is also applicable to other ovens including drop-in ranges and built-in ovens.

Figure 2:
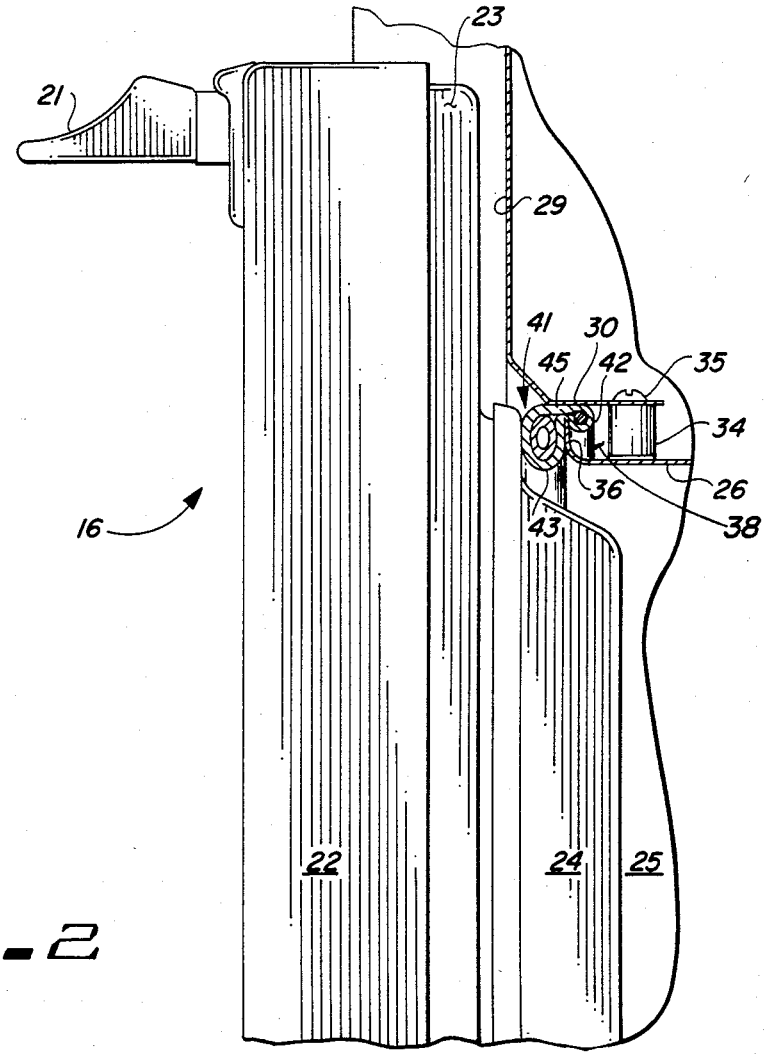
FIG. 2 is a fragmentary section view taken generally along lines 2—2 of FIG. 1 and showing a particular embodiment of the invention.

Turning now to the fragmentary section view of FIG. 2, the oven door 16 is shown in the closed posture of FIG. 1 and the oven seal arrangement is shown in the installed condition. The oven door 16 shown in FIG. 2 is of a conventional construction with a door handle 21 and may further include various interior panels, insulation and window panes (not shown). FIG. 2 illustrates the oven door 16 as including a structural door frame 22, a door liner 23, and an oven plug 24 which extends horizontally into the frontal opening 25 of the oven liner 26.

Figure 3:
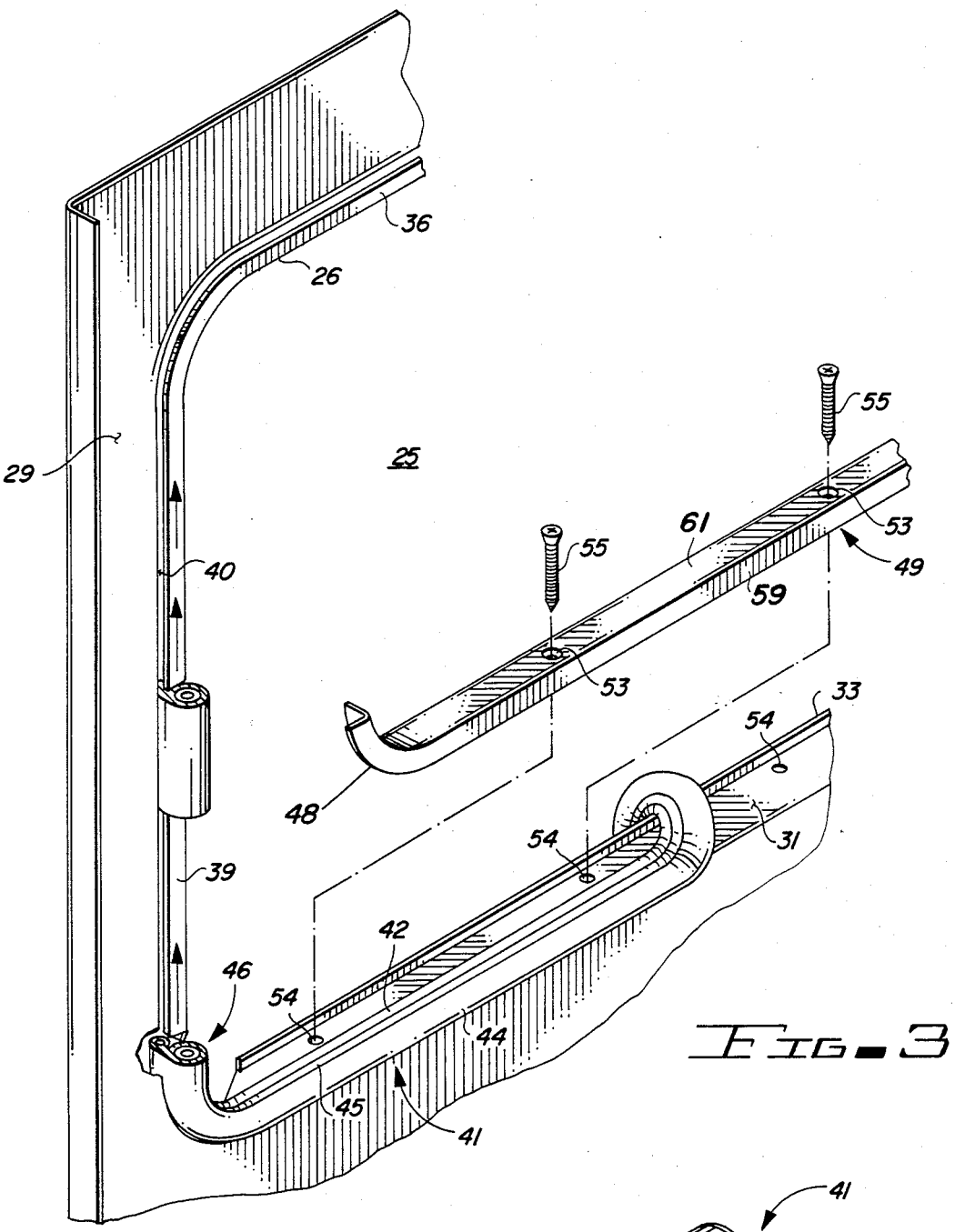
FIG. 3 is an exploded view of the front of an oven showing the assembly of the seal arrangement to the oven.
Figure 5:
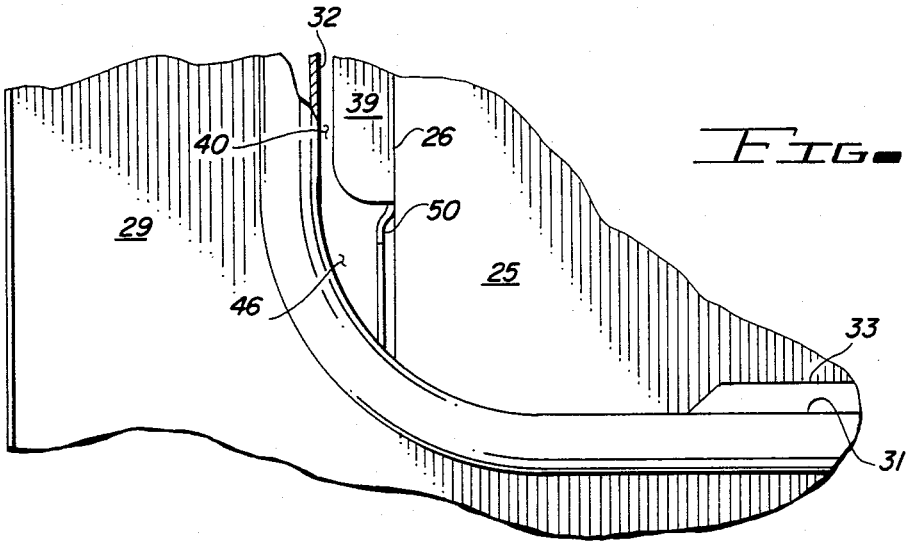
FIG. 5 is a partial view of the lower left-hand corner of the front of the oven showing in greater detail the seal insertion location.

As best shown in FIGS. 2, 3 and 5, the oven includes a substantially vertically oriented main front portion or wall 29 having a generally rectangular opening. The top, bottom and sides of the wall 29 at the rectangular opening are rearwardly formed to define top, bottom and side flanges 30, 31 and 32. As shown in FIG. 3, the bottom flange 31 further includes an upwardly turned edge 33.

As shown in FIGS. 2, 3 and 5, the oven further includes a box-like oven liner 26 having a frontal opening 25 which is generally coplanar with and is mounted within the rectangular opening of the main front portion 29. The oven liner 26 is mounted to the top and side flanges 30 and 32 within the rectangular opening by means of a plurality of mounting brackets or standoffs 34 which are secured to the oven liner 26 as shown in FIG. 2 and connected to the flanges 30 and 32 with appropriate fasteners 35. The physical spacing between the walls of the oven liner 26 and the flanges 30 and 32 of the main front wall 29 provided by the mounting brackets or standoffs 34 define a thermal break therebetween. The mounting brackets 34 are the only points of contact for thermal conduction between the oven liner 26 and the flanges 30 and 32. The top and side edges of the frontal opening 25 of the oven liner 26 are outwardly turned to form top and side flanges 36 and 39. These flanges 36 and 39 are cooperable with the flanges 30 and 32 at the rectangular opening of the main front wall 29 to define a channel 38 behind the flanges 36 and 39 and having a narrowed gap or opening 40 around the periphery of the sides and top of the oven.

Figure 4:
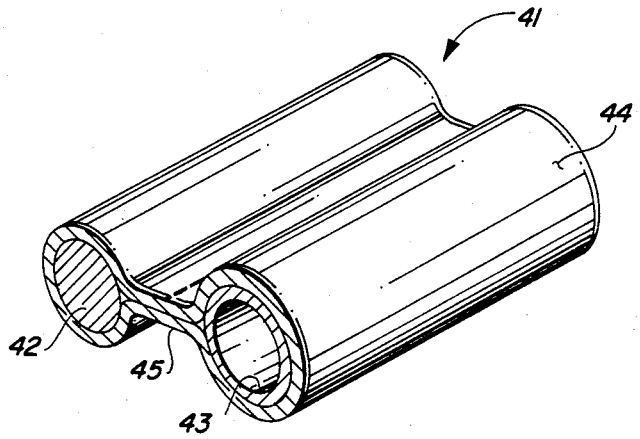
FIG. 4 is an enlarged view of the seal cross section.

FIG. 4 best shows the oven seal 41 in cross section. The oven seal 41 includes a retainer portion 42 and a seal portion 43. The retainer portion 42 of the oven seal 41 is comprised of a stainless steel wire mesh rope. The seal portion 43 of the oven seal 41 is comprised of a stainless steel woven mesh tube. The retainer and seal portions 42 and 43 are covered by a tubular fabric sheath 44 of woven fiber glass material or its equivalent. The stainless steel wire mesh rope and tube which form the interior of the retainer portion 42 and the seal portion 43 of the oven seal 41 are approximately 5/16 inch and 7/16 inch diameters respectively. When the tubular fabric sheath 44 has been placed over the wire mesh rope and woven mesh tube, the sheath 44 is longitudinally stitched between the wire mesh rope and woven mesh tube to define the bulbous retainer and seal portions 42 and 43 as well as an intermediate portion 45. The woven mesh tube of the seal portion 43 allows the seal portion 43 to be compressed between the oven plug 24 and the flanges 36 and 39 of the oven liner 26.

FIGS. 3 and 5 illustrate the lower left corner of the oven and the break or opening 46 in the gap or opening 40 through which the retainer portion 42 of the oven seal 41 is passed during assembly. The lower right hand corner of the oven is similarly formed so that the oven seal 41 can be started at either corner. As best shown in FIG. 5, the side flange 39 of the oven liner 26 is interrupted at the opening 46 and the wall of the oven liner 26 includes an outwardly stepped portion 50 in this break or opening 46. As will be further discussed herein, once the oven seal 41 has been installed around the periphery of the oven, an oven seal retainer 49 will be attached to the bottom flange 31 of the main front wall 29. The oven seal retainer 49 includes upwardly curved end portions 48 which allow it to engage with the outwardly stepped portion 50 in the break or opening 46.

Referring now specifically to FIGS. 3 and 4, in the preferred method of assembly or replacement of the oven seal 41, the intermediate portion 45 of the oven seal 41 is inserted into the break or opening 46 and into the gap or opening 40 so that the retainer portion 42 of the oven seal 41 is trapped in the channel 38 behind the side flange 39 of the oven liner 26 as shown in FIG. 3. The oven seal 41 is then pulled around the periphery of the oven liner 26 and when in the installed posture of FIG. 2, the seal portion 43 will be engageable with the top and side flanges 36 and 39 of the oven liner 26 and with the oven plug portion 24 of the oven door 16. A portion of the oven seal 41 will engage with the plug portion 24 along the bottom of the opening as will be shown FIG. 3 also depicts the oven seal 41 as being draped over the upwardly turned edge 33 of the bottom flange 31 of the main front wall 29. This is shown only as related to assembly where the total length of the oven seal 41 might be placed inside the oven cavity for convenience. When the oven seal 41 has been installed around the periphery of the oven the two ends of the oven seal 41 will be spaced apart at the bottom flange 31 to provide an air gap at approximately the center of the bottom flange 31. At all other locations around the periphery of the oven liner 26 the retainer portion 42 and intermediate portion 45 will provide a thermal break between the oven liner 26 and wall portion 29 and the seal portion 43 will provide a seal between the liner 26 and door plug 24.

Figure 6:
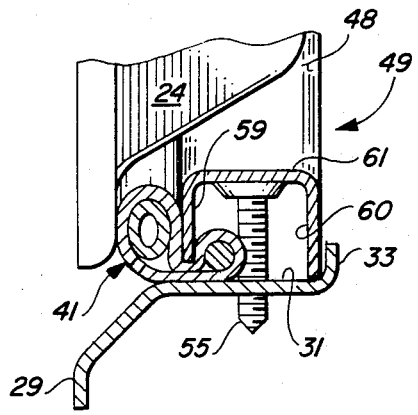
FIG. 6 is a fragmentary section view taken through the oven seal retainer when assembled to the bottom flange of the oven main front.

Referring now to FIGS. 3 and 6, the oven seal retainer 49 is provided in this embodiment for securing the ends of the oven seal 41 to the bottom flange 31 of the main front wall 29 and thereby preventing longitudinal movement of the oven seal 41 relative to the channel 38. The oven seal retainer 49 is generally an inverted U-shape in cross-sectional configuration as best shown in FIG. 6. The oven seal retainer 49 includes a pair of vertically disposed front and rear legs 59 and 60 with the front leg 59 in contact with the intermediate portion 45 of the oven seal 41 and the rear leg 60 butted up against the upwardly turned edge 33. The front leg 59 of the oven seal retainer 49 when installed will functionally correspond generally to the side and top flanges 36 and 39 of the oven liner 26. The generally horizontally disposed web section 61 of the oven seal retainer 49 includes a plurality of apertures 53 which are aligned with apertures 54 in the bottom flange 31 for receiving threaded fasteners 55. When installed, the oven seal retainer 49 combines with the bottom flange 31 of the main front 29 to generally define a continuation of the channel or gap 40 and a front leg 59 for engaging with the oven seal 41. The rear leg 60 is relieved or cut away at each end so that the upwardly curved ends 48 of the oven seal retainer 49 will cooperate, as previously discussed, with the outwardly stepped portion 50 of the oven liner wall at the break 46 in the channel or gap 40 shown in FIG. 5.

The preferred embodiment of the invention has thus described a particular flange arrangement between the main front wall 29 and the oven liner 26 to form the channel 38 and gap or opening 40 for receiving the retainer and intermediate portions 42 and 45 of the oven seal 41. It is to be understood that other combinations of flanges for achieving a workable channel 38 and gap or opening 40 for the oven seal 41 are possible. It is further understood that the use of an oven seal retainer 49 in the preferred embodiment does not limit the invention to that particular structure since the channel 38 and gap 40 could be extended across the bottom of the oven opening or a configuration of the oven seal retainer 49 could be located at the top or on a side of the oven opening.

Figure 7:
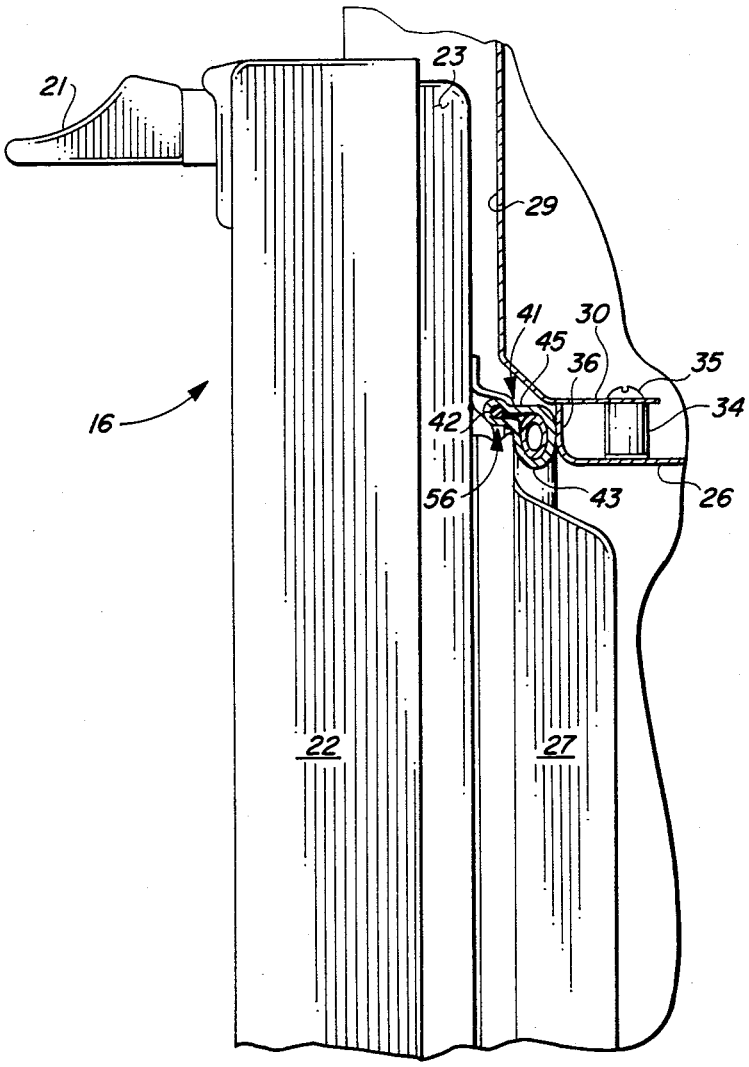
FIG. 7 is a section view similar to FIG. 2 showing an alternate embodiment of the invention.

Turning now to FIG. 7 there is shown an embodiment of the instant invention where the oven seal 41 is mounted on the oven door 16. In this embodiment, the oven plug portion 27 of the oven door 16 is modified to include a channel 56 around the periphery of the oven opening. In this embodiment the oven seal 41 is started into the channel 56 and is pulled around the channel 56 with the retainer portion 42 trapped behind the oven plug 27.

There has thus been described herein an improved flexible oven seal arrangement which is easily assembled or disassembled from the oven without requiring major teardown thereof.

In the drawings and specification, there has been set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as further defined in the following claims.

I claim:

1. An oven seal arrangement, comprising: oven means including a stationary portion defining an oven cavity open at one end and a wall portion adjacent and generally surrounding the open end of said oven cavity, said oven means further including a movable portion in the form of oven door means operable between an open position and a closed position juxtaposed to said wall portion for effectively covering the open end of said oven cavity; flange means associated with said oven means and defining a channel in one of said stationary and movable portions extending along at least a portion of the perimeter of the open end of said oven cavity with said oven door means in said closed position, said channel having a narrow longitudinal opening formed by said flange means and further having seal entry means; and elongated seal means including a retainer portion, a seal portion and an intermediate web portion interconnecting said retainer and seal portions, said retainer and intermediate portions being of effectively smaller cross-section than said channel and said narrow longitudinal opening to be slidably received therein at said seal entry means and to permit longitudinal sliding movement of said elongated seal means relative to said channel for positioning said seal portion in sealing juxtaposition to said stationary and movable portions.

2. An oven seal arrangement as defined in claim 1 wherein said flange means defining a channel is associated with said oven door means.

3. An oven seal arrangement as defined in claim 1 wherein said flange means defining a channel is associated with said wall portion.

4. An oven seal arrangement as defined in claim 3 wherein said flange means defining a channel includes first and second flange means associated with said oven cavity and said wall portion, said first and second flange means being mutually cooperable for defining said narrow longitudinal opening.

5. An oven seal arrangement as defined in claim 1 and further including auxiliary channel means for holding said seal means and preventing movement within said channel.

6. An oven having a removable seal, comprising: oven means including a box-like oven liner having one open end and defining an oven cavity, said oven means further including a front wall portion fixed to said oven liner in a preassembled posture to define with said oven liner an access opening; flange means associated with said oven liner and said front wall portion of said oven means and cooperable in said preassembled posture for defining a channel extending along at least a portion of the periphery of said access opening, said channel having a narrow longitudinal opening and further having seal entry means; elongated seal means including a retainer portion generally smaller in cross section than said channel but substantially larger in cross section than said narrow longitudinal opening for transverse retention of said retainer portion in said channel, said elongated seal means further including a seal portion and an intermediate portion interconnecting said retainer and seal portions and generally smaller in cross section than said narrow longitudinal opening, said retainer and intermediate portions of said elongated seal means adapted to be longitudinally slidably received in said channel and said narrow longitudinal opening respectively, said seal entry means formed to permit assembly and removal of said retainer portion from said channel whereby said elongated seal means may be longitudinally moved relative to said channel along the periphery of said oven cavity to install said seal portion along said access opening and to optionally remove said elongated seal means from said installed position without altering the preassembled posture of said oven liner and front wall portion; and an oven door operable between an open position and a closed position juxtaposed to said front wall portion for closing said oven cavity and engageable with said seal portion to provide a seal between said oven means and said oven door.

7. An oven as defined in claim 6 wherein said front wall portion includes rearwardly extending flange means along at least one side and wherein an auxiliary retaining channel effectively clamps said elongated seal means to said flange means.

8. An oven as defined in claim 6 wherein the ends of said elongated seal means when assembled are spaced apart to provide an air gap in said elongated seal means for permitting limited airflow into said oven.

9. An oven as defined in claim 6 wherein said peripheral channel further includes neans defining a thermal break between said oven liner and said front wall portion of said oven means.

10. An oven having a removable seal, comprising: oven means including a box-like oven liner having one open end and defining an oven cavity, said oven means further including a front wall portion associated with said oven liner in a preassembled posture to define an access opening; flange means associated with said oven liner and said front wall portion of said oven means and cooperable in said preassembled posture for defining a channel extending along at least a portion of the periphery of said access opening, said channel having a narrow longitudinal opening and seal entry means; elongated seal means including in cross section an enlarged retainer portion, a seal portion and an intermediate web portion interconnecting said retainer and seal portions, said retainer portion being sufficiently larger than said narrow longitudinal opening for transverse retention of said retainer portion in said channel, said retainer and intermediate portions being sufficiently smaller than said channel and said narrow longitudinal opening, respectively to permit longitudinal sliding movement of said elongated seal means relative to said channel, said seal entry means being of sufficient size to receive said retainer portion whereby said elongated seal means may be threaded into and along said channel to operably position said seal portion substantially along said access opening; and an oven door operable between an open position and a closed position juxtaposed to said front wall portion for closing said oven cavity and engageable with said seal portion to provide a seal arrangement between said oven means and said oven door.

11. An oven as defined in claim 10 and further including auxiliary channel means engageable with a portion of said elongated seal means after installation along said access opening for preventing longitudinal dislocation of said elongated seal means.

12. A method of assembling an elongated flexible oven seal along the periphery of an access opening of an oven, the oven having a box-like oven liner defining an oven cavity substantially open on one side and further having a front-wall portion cooperative with the oven liner for defining said access opening, said oven liner and said front wall portion each including flange means for defining a generally peripheral channel having a narrow longitudinal opening and seal entry means in at least one location along said peripheral channel, comprising the steps of: inserting an end of an enlarged retainer portion of said elongated oven seal into said channel through said seal entry means for trapping said retainer portion within said channel and positioning a reduced intermediate portion of said elongated oven seal within said narrow elongated opening and a seal portion juxtaposed to said front wall portion of the oven; and feeding said retainer portion into said channel through said seal entry means while longitudinally sliding said retainer portion within said channel for operably positioning said seal portion substantially along the periphery of the oven access opening.

13. A method of assembling an elongated flexible oven seal along the periphery of an access opening of an oven, as defined in claim 12, further comprising: positioning and fixing the ends of said oven seal in a spaced-apart arrangement to define a gap in said oven seal for permitting limited airflow into said oven and preventing longitudinal dislocation of said oven seal.

* * * * *